US009120310B2

(12) United States Patent
Ishida et al.

(10) Patent No.: US 9,120,310 B2
(45) Date of Patent: Sep. 1, 2015

(54) RECORDING ELEMENT SUBSTRATE, METHOD OF MANUFACTURING THE RECORDING ELEMENT SUBSTRATE, AND LIQUID EJECTION HEAD

(75) Inventors: Yuzuru Ishida, Yokohama (JP); Hirokazu Komuro, Yokohama (JP); Ichiro Saito, Yokohama (JP); Makoto Sakurai, Kawasaki (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1536 days.

(21) Appl. No.: 12/730,117

(22) Filed: Mar. 23, 2010

(65) Prior Publication Data

US 2010/0245486 A1 Sep. 30, 2010

(30) Foreign Application Priority Data

Mar. 25, 2009 (JP) ..... 2009-074363

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14129* (2013.01); *B41J 2/1408* (2013.01); *B41J 2/1603* (2013.01); *B41J 2/1632* (2013.01); *B41J 2/1642* (2013.01); *B41J 2/1643* (2013.01); *B41J 2/1646* (2013.01); *Y10T 29/49401* (2015.01)

(58) Field of Classification Search

CPC .... B41J 2/1408; B41J 2/3358; B41J 2/33595; B41J 2202/08

See application file for complete search history.

(56) References Cited

U.S. PATENT DOCUMENTS

| | | | | |
|---|---|---|---|---|
| 6,305,790 | B1 * | 10/2001 | Kawamura et al. | 347/65 |
| 2007/0076056 | A1 * | 4/2007 | Kim et al. | 347/61 |
| 2007/0126804 | A1 * | 6/2007 | Shim et al. | 347/71 |

FOREIGN PATENT DOCUMENTS

| | | | |
|---|---|---|---|
| JP | 62-231761 | A | 10/1987 |
| JP | 03-073351 | A | 3/1991 |
| JP | 6-134988 | | 5/1994 |
| JP | 08-112925 | A | 5/1996 |
| JP | 2005-280179 | | 10/2005 |
| JP | 2009-006559 | A | 1/2009 |

* cited by examiner

*Primary Examiner* — Geoffrey Mruk

(74) *Attorney, Agent, or Firm* — Canon USA Inc IP Division

(57) ABSTRACT

A recording element substrate includes a substrate; an insulating layer disposed on the substrate; a plurality of heating portions which are arranged on the insulating layer and which produce thermal energy used to eject a liquid; and a plurality of heat conduction members, each being located between adjacent heating portions with respect to an arrangement direction of the heating portions, the heat conduction members being located between the substrate side principal surface of the insulating layer and the heating portion side principal surface of the insulating layer and having higher thermal conductivity than the insulating layer. The heat conduction members are in contact with a heat conduction layer which has higher thermal conductivity than the insulating layer.

10 Claims, 10 Drawing Sheets

RECORDING ELEMENT SUBSTRATE, METHOD OF MANUFACTURING THE RECORDING ELEMENT SUBSTRATE, AND LIQUID EJECTION HEAD

BACKGROUND OF THE INVENTION

1. Field of the Invention

The present invention relates to a recording element substrate configured to perform recording using thermal energy, a method of manufacturing the recording element substrate, and a liquid ejection head.

2. Description of the Related Art

As thermal recording devices in which recording is performed by heating a plurality of heating portions provided therein, sublimation-type recording devices and inkjet-type recording devices are known. In a sublimation-type recording device, recording is performed by a method in which ink on an ink ribbon is melted by heat and transferred onto a recording medium, while in an inkjet-type recording device, recording is performed by a method in which a liquid, such as ink, is subjected to film boiling, thereby ejecting the ink. In these recording devices, in order to diffuse excess heat generated in heating portions, a substrate having high thermal conductivity is used as a recording element substrate (hereinafter, may be also referred to as a "head substrate"). In order to perform continuous recording efficiently, it is necessary to dispose a heat storage layer which stores a certain amount of heat between the heating portions and the substrate. An insulating layer used as an electrode insulation film also serves as the heat storage layer.

However, in the case where a multilayer wiring substrate is used to reduce the size of a head substrate, in order to ensure insulation of electrodes, it is necessary to increase the thickness of an interlayer insulation layer. In an inkjet-type recording device, if the thickness of an interlayer insulation layer is increased in such a manner, there is a possibility that an excessive amount of heat may be stored in the insulation layer, and the ejection amount of ink may be changed under the influence of heat, resulting in a degradation of image quality and the like. Furthermore, a protection film is disposed over the heating portions, the protection film protecting the heating portions from moisture, etc. However, it is known that if the surface temperature of the heating portions increases excessively, the protection film is degraded due to thermal stress. In order to dissipate the heat of heating portions, a structure including a heat conduction layer is disclosed in Japanese Patent Laid-Open No. 2005-280179.

An inkjet head substrate disclosed in Japanese Patent Laid-Open No. 2005-280179 is shown in FIG. 9. The head substrate shown in FIG. 9 includes a heating region 27*a* which is used as a heating portion, a second interlayer insulation layer 26 which is composed of a $SiO_2$ film and disposed under the heating region 27*a*, and a heat conduction layer 35 disposed in the second interlayer insulation layer 26, the heat conduction layer 35 being configured to dissipate heat. The heat conduction layer 35 is composed of a material that has higher thermal conductivity than the second interlayer insulation layer 26. The heat conduction layer 35 is opposed substantially in parallel to the heating portion and is larger, by a predetermined distance a, than the circumference of the heating portion. In such a structure, heat of the heating portion is diffused in a planar direction, and as a result, degradation of the surface of the protection film can be suppressed.

In recent years, there have been demands for higher speed, higher image quality, and higher durability in recording devices. In order to meet such demands, there has been a need for head substrates in which recording elements are arranged at a higher density. The recording elements each include a heating portion and an ejection port, and it is necessary to arrange heating portions at a high density in order to provide recording elements at a high density. When high-speed recording is performed using such a head substrate, even if the heat conduction layer 35 is disposed in the second insulating layer as disclosed in Japanese Patent Laid-Open No. 2005-280179, heat generated in the heating portion is not selectively transmitted downward to a region in which the heat conduction layer 35 is located, and there is a possibility that heat dissipation may not be performed efficiently. If heat dissipation is not performed efficiently, the temperature of the entire substrate may be increased because of thermal interference between the adjacent heating portions arranged at a high density, resulting in a shift of ink ejection timing and other problems, which lead to a degradation in recorded image quality.

SUMMARY OF THE INVENTION

The present invention provides a highly reliable recording element substrate in which even when high-speed recording is performed using heating portions arranged at a high density, it is possible to reduce thermal interference between the adjacent heating portions and stable recording can be performed.

According to an aspect of the present invention, there is provided a recording element substrate including a substrate; an insulating layer disposed on or above the substrate; a plurality of heating portions which are arranged on the insulating layer and which produce thermal energy used to eject a liquid; a heat conduction layer disposed inside the insulating layer and having higher thermal conductivity than the insulating layer; and a plurality of heat conduction members, each being located between adjacent heating portions with respect to an arrangement direction of the heating portions, the heat conduction members passing through the insulating layer between a surface of the insulating layer on which the heating portions are arranged and the heat conduction layer so as to be in contact with the heat conduction layer, the heat conduction members having higher thermal conductivity than the insulating layer.

According to another aspect of the present invention, there is provided a method of manufacturing a recording element substrate including a substrate, an insulating layer disposed on or above the substrate, and a plurality of heating portions which are arranged on the insulating layer and which produce thermal energy used to eject a liquid, the method including supplying a substrate having an insulating layer and a heat conduction layer on one surface of the substrate, the heat conduction layer being disposed between the insulating layer and the substrate and composed of a material having higher thermal conductivity than the insulating layer; forming a plurality of openings in the insulating layer to expose the heat conduction layer; filling the plurality of openings with a material that has higher thermal conductivity than the insulating layer to form a plurality of heat conduction members which are in contact with the heat conduction layer; and forming the heating portions on the insulating layer between the adjacent heat conduction members so as not to be in contact with the heat conduction members.

According to the present invention, by disposing the heat conduction members, which have higher thermal conductivity than the insulating layer, between the adjacent heating portions, it is possible to efficiently dissipate heat generated in the heating portions. Consequently, it is possible to provide a highly reliable recording element substrate in which, even when high-speed recording is performed using heating portions arranged at a high density on the recording element substrate, thermal interference between the adjacent heating portions can be prevented and stable recording can be performed.

Further features of the present invention will become apparent from the following description of exemplary embodiments with reference to the attached drawings.

BRIEF DESCRIPTION OF THE DRAWINGS

FIGS. 5-1A and 5-1B to 5-3A and 5-3B are each a schematic cross-sectional view showing a manufacturing step of the recording element substrate according to the embodiment of the present invention.

FIG. 10-1 is a schematic plan view of a recording element substrate according to a fourth embodiment and FIGS. 10-2 and 10-3 are each a schematic cross-sectional view of the recording element substrate shown in FIG. 10-1.

DESCRIPTION OF THE EMBODIMENTS

Embodiments of the present invention will be described with reference to the drawings.

Figure 6:
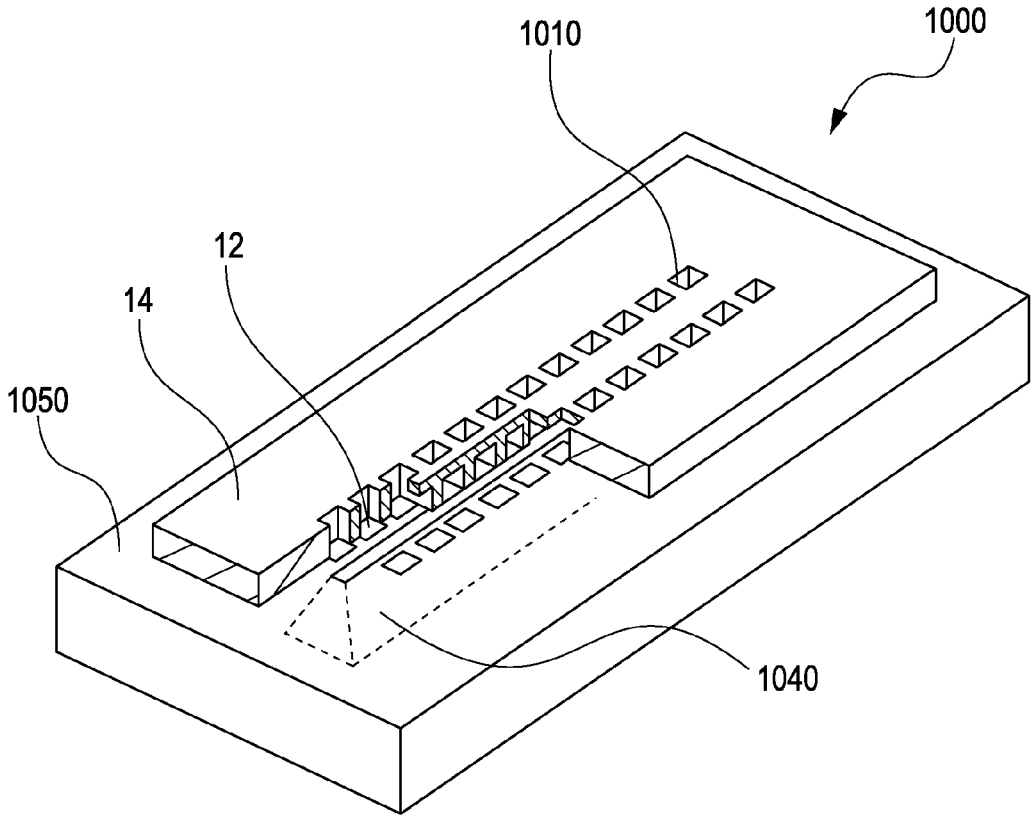
FIG. 6 is a schematic perspective view of a liquid ejection head according to an embodiment of the present invention.

A recording element substrate according to the present invention can be used, for example, in a liquid ejection head shown in FIG. 6. A liquid ejection head 1000 shown in FIG. 6 includes an orifice plate 14 constituting ejection ports 1010 and a passage, and a recording element substrate 1050 having heating portions 12 and a supply port 1040.

A liquid, such as ink, is supplied from the supply port 1040, flows through the passage constituted by the orifice plate 14, and is fed onto the heating portions 12 on their respective the ejection ports 1010. When the heating portions 12 are heated to about 700° C. to 800° C., the ink on the heating portions 12 is subjected to film boiling. The bubbles generated by the film boiling eject ink from the ejection ports 1010, and thereby recording is performed.

As shown in FIG. 6, the ejection ports 1010 are arranged at a predetermined pitch, and the heating portions 12 are arranged so as to correspond to the ejection ports 1010. FIG. 6 shows an example in which the number of rows of ejection ports 1010 is two. Depending on recording element substrates, a plurality of rows of recording elements including such ejection ports 1010 and heating portions 12 may be arranged.

Figure 1:
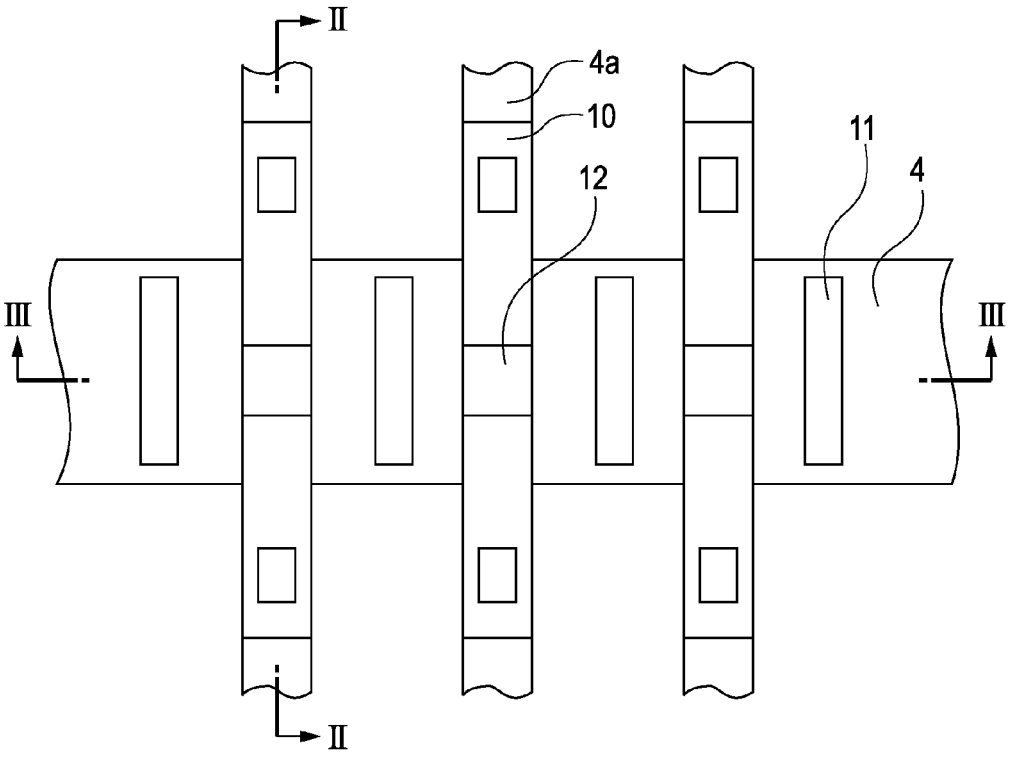
FIG. 1 is a schematic plan view showing a liquid ejection head according to an embodiment of the present invention.

FIG. 1 is a schematic plan view showing a part of a liquid ejection head. A recording element substrate includes electrodes 10, a heat conduction layer 4, an electrode layer 4*a*, heat conduction members 11, and heating portions 12. The electrodes 10 are electrically connected to the heating portions 12, and when electric current is passed through the electrodes 10, the heating portions 12 are heated to about 700° C. to 800° C. Using this thermal energy, ink on the heating portions 12 is subjected to film boiling, and a liquid, such as ink, is ejected from the ejection ports. The heat conduction members 11 are disposed between the adjacent heating portions 12.

Figure 2:
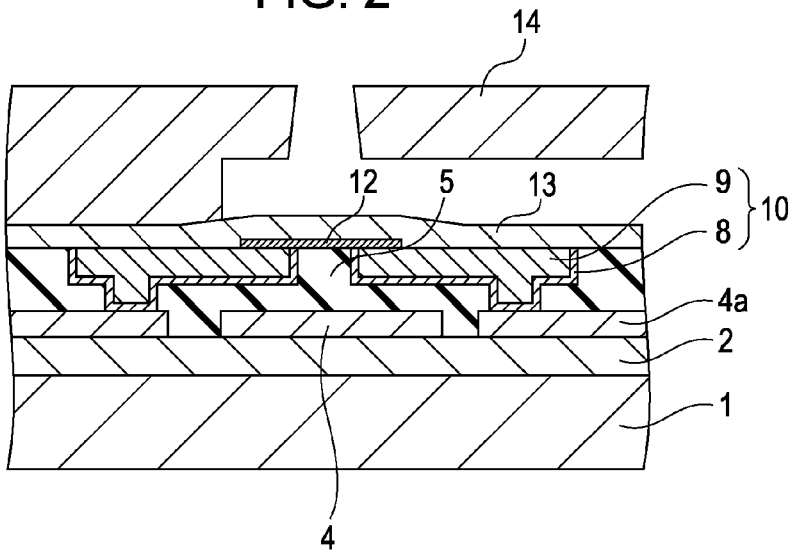
FIG. 2 is a schematic cross-sectional view of the liquid ejection head shown in FIG. 1 taken along the line II-II.

FIG. 2 is a schematic cross-sectional view of the liquid ejection head shown in FIG. 1 taken along the line II-II. As shown in FIG. 2, an interlayer film 2 composed of boron- and phosphorus-doped $SiO_2$ is disposed at a thickness of 500 to 1,000 nm on a substrate 1 composed of silicon. The heat conduction layer 4 and the electrode layer 4*a* are disposed on the interlayer film 2. As the material for the heat conduction layer 4 and the electrode layer 4*a*, for example, a material containing one or more selected from Al, Cu, W, and Au can be used, and desirably, an Al—Si alloy can be used. The thickness of the heat conduction layer 4 and the electrode layer 4*a* can be 200 to 500 nm. An insulating layer 5 composed of $SiO_2$ is disposed at a thickness of about 1 μm on the heat conduction layer 4 and the electrode layer 4*a*. The insulating layer 5 has low thermal conductivity, and thus also serves as a heat storage layer that can store the heat of the heating portion 12 when continuous recording is performed. The heating portion 12 composed of TaSiN, WSiN, or the like is disposed at a thickness of 10 to 50 nm on the insulating layer 5. The electrodes 10 connected to the electrode layer 4*a* are disposed at both ends of the heating portion 12. The electrodes 10 each include a film 8 composed of a Ta/TaN laminated film or the like, which serves as an adhesion film for the insulating layer 5 and a diffusion barrier film, and a film 9, for example, composed of one or more selected from Al, Cu, and Au.

A protection film 13 composed of SiN, SiC, or the like is disposed at a thickness of 100 to 500 nm over the heating portion 12 and the electrodes 10. The protection film 13 protects the heating portion 12 and the electrodes 10 from corrosion due to a liquid, such as ink, and also serves as a diffusion barrier film against the metal constituting the electrodes 10. An orifice plate 14 constituting an ejection port configured to eject a liquid is disposed on the protection film 13.

Figure 3:
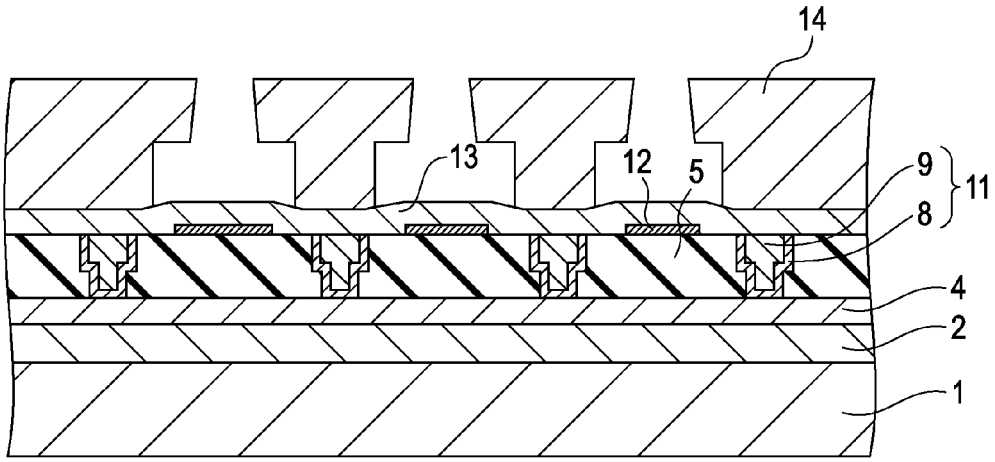
FIG. 3 is a schematic cross-sectional view of the liquid ejection head shown in FIG. 1 taken along the line III-III.

FIG. 3 is a schematic cross-sectional view of the liquid ejection head shown in FIG. 1 taken along the line III-III in the arrangement direction of the recording elements. The heat conduction members 11 are disposed between the adjacent heating portions 12, and the insulating layer 5 is arranged so as to always be interposed between the heat conduction member 11 and the heating portion 12 which are adjacently located.

The heat conduction members 11 can each include the film 8 and the film 9 as in the electrodes 10, and the heat conduction members 11 and the electrodes 10 can be formed at one time. By forming the heat conduction members 11 and the electrodes 10 at one time in such a manner, the time required for manufacture can be shortened. Furthermore, as shown in FIGS. 2 and 3, the heat conduction members 11 and the electrodes 10 can be disposed so as to fill recesses formed in the surface of the insulating layer 5 on which the heating portions 12 are arranged. The surfaces of the heat conduction members 11 and the electrodes 10 can be smooth. Consequently, even when the ejection ports 1010 are formed in the orifice plate 14 by a photolithographic technique after the heat conduction members 11 and the electrodes 10 are formed, it is possible to prevent the shape of the ejection ports 1010 from being deformed.

As the method for disposing the heat conduction members 11 and the electrodes 10 on the surface of the insulating layer 5, a damascene process or the like can be employed. The damascene process refers to a method in which grooves having an electrode shape are formed in an insulating layer, a metal used for electrodes is embedded therein, and then, the excess metal other than the metal in the grooves is removed to form electrodes.

The material for the film 9 constituting the heat conduction members 11 can have a thermal conductivity that is ten or more times that of a material used for the insulating layer 5. The heat conduction members 11 are connected to the heat conduction layer 4 and the substrate 1 which have higher thermal conductivity than the insulating layer 5.

By disposing the heat conduction members 11 having higher thermal conductivity than the insulating layer between the adjacent heating portions 12 with respect to the arrangement direction, heat generated in the heating portions 12 is transmitted from the insulating layer 5 to the heat conduction members 11, and further can be transmitted to the heat conduction layer 4 and the substrate 1. Thereby, heat generated in the heating portions 12 can be efficiently dissipated, and it is possible to prevent an increase in the temperature of the insulating layer 5 surrounding the heating portions 12.

Consequently, even when high-speed recording is performed using the recording element substrate 1050 having the heating portions 12 arranged at a high density, heat of the adjacent heating portions 12 is not transmitted through the insulating layer 5 to cause thermal interference. It is possible to provide a highly reliable recording element substrate capable of performing stable recording.

The width of each of the heat conduction members 11 in a direction orthogonal to the arrangement direction can be larger than the width of each of the heating portions 12 in the direction orthogonal to the arrangement direction. By setting the width of the heat conduction members 11 in the direction orthogonal to the arrangement direction to be large, heat of the heating portions 12 extending radially can be more efficiently absorbed, and thermal interference of the adjacent heating portions 12 can be prevented.

In the case where the arrangement density of recording elements is 600 dpi or more, the recording element substrate according to the present invention can have a large effect because the distance between the adjacent heating portions 12 is decreased. If the distance between each of the heat conduction members 11 and its adjacent heating portion 12 is too small, the insulating layer 5 cannot produce an effect as a heat storage layer, and heat of the heating portion 12 escapes to the heat conduction member 11 before ink is subjected to film boiling. Therefore, each of the heat conduction members 11 can be located at a position 1 μm or more away from its adjacent heating portion 12. On the other hand, if the distance between each of the heat conduction members 11 and its adjacent heating portion 12 is increased, the pitch of the heating portions 12 increases, thus increasing the size of the recording element substrate. As a result, it is not possible to provide recording elements that can meet requirements for higher speed, higher image quality, and higher durability in recording devices. Therefore, the distance between each of the heat conduction members 11 and its adjacent heating portion 12 can be 1 to 5 μm.

First Embodiment

An embodiment of the present invention will be described with reference to FIGS. 2 and 3. As shown in FIG. 2, an interlayer film 2 composed of boron- and phosphorus-doped $SiO_2$ is disposed at a thickness of 500 nm on a Si substrate 1 provided with active elements, such as transistors (not shown). A heat conduction layer 4 and an electrode layer **4*a* composed of an Al—Si alloy are disposed at a thickness of 400 nm on the interlayer film 2. An insulating layer 5 composed of $SiO_2$ is disposed at a thickness of 1 μm on the heat conduction layer 4 and the electrode layer 4*a*. The insulating layer 5 also serves as a heat storage layer that stores the heat of the heating portions 12. The heating portions 12 composed of TaSiN are disposed at a thickness of 50 nm on the insulating layer 5. Both ends of each heating portion 12 are in contact with electrodes 10. The electrodes 10 are in contact with the electrode layer 4*a* through contact holes provided in the insulating layer 5**.

The electrodes 10 each include a film 9 composed of Cu formed by plating and a film 8 composed of Ta/TaN, which serves as a diffusion barrier layer. A protection film 13 composed of $Si_3N_4$ is disposed at a thickness of 300 nm entirely over the heating portions 12 and the electrodes 10 in order to prevent corrosion due to a liquid, such as ink. Furthermore, an orifice plate 14 is formed by a photolithographic technique on the substrate.

As shown in FIG. 3, heat conduction members 11 are disposed between the adjacent heating portions 12, the heat conduction members 11 each including a film 9 composed of Cu and a film 8 composed of Ta/TaN serving as a diffusion barrier layer as in the electrodes 10 shown in FIG. 2. The insulating layer 5 is arranged so as to always be interposed between each of the heat conduction members 11 and its adjacent heating portion 12. By forming the electrodes 10 and the heat conduction members 11 simultaneously using the same material, it is possible to form the heat conduction members 11 without increasing the number of steps during the manufacturing process. Furthermore, as shown in FIGS. 2 and 3, the heat conduction members 11 and the electrodes 10 can be disposed between a substrate 1 side principal surface of the insulating layer 5 and a heating portion 12 side principal surface of the insulating layer 5 so as to be embedded from the surface of the insulating layer 5, and the surfaces of the heat conduction members 11 and the electrodes 10 can be smoothed. Consequently, even when the ejection ports 1010 are formed in the orifice plate 14 by a photolithographic technique after the heat conduction members 11 and the electrodes 10 are formed, it is possible to prevent the shape of the ejection ports 1010 from being deformed.

The thermal conductivity of $SiO_2$ used for the insulating layer 5 is several Watts Per Meter Per Kelvin (W/mK), and the thermal conductivity of $Si_3N_4$ used for the protection film 13 is 70 W/mK, while the thermal conductivity of Cu used for the film 9 is about 400 W/mK. The thermal conductivity of the heat conduction layer 4 is about 230 W/mK.

By disposing the heat conduction members 11 having higher thermal conductivity than the insulating layer between the adjacent heating portions 12 with respect to the arrangement direction, heat generated in the heating portions 12 is transmitted from the insulating layer 5 to the heat conduction members 11, and further can be transmitted to the heat conduction layer 4 and the substrate 1. Thereby, heat generated in the heating portions 12 can be efficiently dissipated, and it is possible to prevent an increase in the temperature of the insulating layer 5 surrounding the heating portions 12.

Consequently, even when high-speed recording is performed using the recording element substrate 1050 having the heating portions 12 arranged at a high density, heat of the adjacent heating portions 12 is not transmitted through the insulating layer 5 to cause thermal interference. It is possible to provide a highly reliable recording element substrate capable of performing stable recording.

In this embodiment, the width of each of the heating portions 12 in the arrangement direction and the width of each of the heating portions 12 in the direction orthogonal to the arrangement direction are each 10 μm, and the arrangement pitch of the adjacent heating portions 12 is 30 μm. The width of each of the heat conduction members 11 in the arrangement direction is 10 μm, and the width of each of the heat conduction members 11 in the direction orthogonal to the arrangement direction is 30 μm. In such a manner, by setting the width of each of the heat conduction members 11 in the direction orthogonal to the arrangement direction to be larger than the width of each of the heating portions 12 in the direction orthogonal to the arrangement direction, heat of the heating portions 12 extending radially can be efficiently absorbed, and thermal interference of the adjacent heating portions 12 can be prevented.

The arrangement is made such that the shortest distance between each of the heat conduction members 11 and its adjacent heating portion 12 is 5 μm. If the distance between each of the heat conduction members 11 and its adjacent heating portion 12 is too small, the insulating layer 5 cannot produce an effect as a heat storage layer, and heat of the heating portions 12 escapes to the heat conduction members 11 before ink is subjected to film boiling.

A method of manufacturing a recording element substrate according to this embodiment will now be described with reference to FIGS. 4-1A and 4-1B to 5-3A and 5-3B. FIGS. 4-1A and 4-1B to 5-3A and 5-3B are each a schematic cross-sectional view showing a manufacturing step of the recording element substrate. In this embodiment, heat conduction members 11 are formed using a damascene process.

An interlayer film 2 composed of BPSG, i.e., boron- and phosphorus-doped $SiO_2$, is formed on one surface of a Si substrate 1 provided with active elements, such as transistors. The interlayer film 2 is subjected to patterning, and a contact opening 3 is formed by etching (refer to FIGS. 4-1A and 4-1B).

Next, using Al—Si, a layer having higher thermal conductivity than an insulating layer 5 is formed and subjected to patterning in a shape of a heat conduction layer 4 and an electrode layer 4*a* which communicate with the contact opening 3. In this step, by also forming the heat conduction layer 4 so as to be located below each heating portion 12, heat of the heating portion 12 can be more efficiently dissipated (refer to FIGS. 4-2A and 4-2B).

Next, the insulating layer 5 composed of $SiO_2$ is formed by CVD at a thickness of about 1.5 μm over the heat conduction layer 4 and the electrode layer 4*a*. Since the film formation by CVD is influenced by the shape of the underlying layer, the thickness is set larger than the required thickness. Then, smoothing is performed by polishing using CMP to obtain the insulating layer 5 with a thickness of 1 μm (refer to FIGS. 4-3A and 4-3B).

Figures 1A, 4:
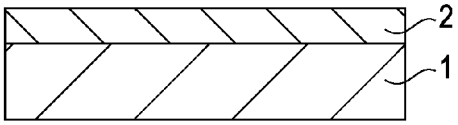
FIGS. 4-1A and 4-1B to 4-4A and 4-4B are each a schematic cross-sectional view showing a manufacturing step of a recording element substrate according to an embodiment of the present invention.
Figures 1B, 4:
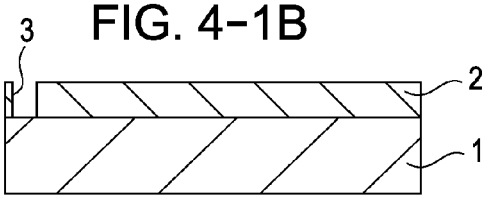
Figures 2A, 4:
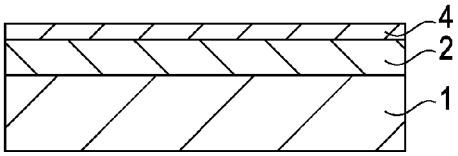
Figures 2B, 4:
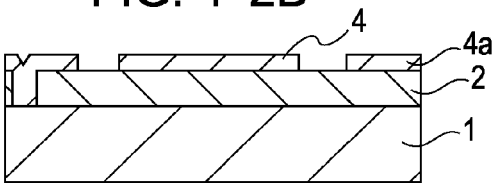
Figures 3A, 4:
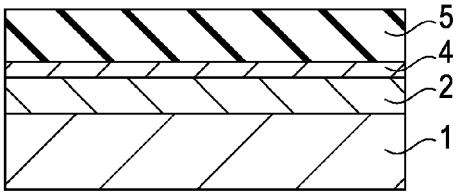
Figures 3B, 4:
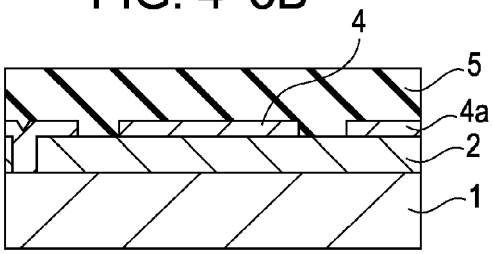
Figures 4, 4A:
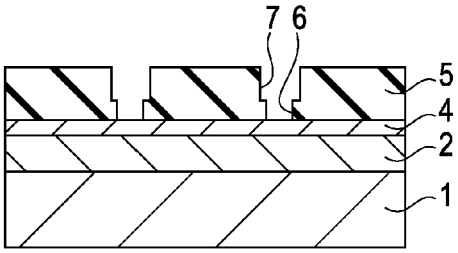
Figures 4, 4B:
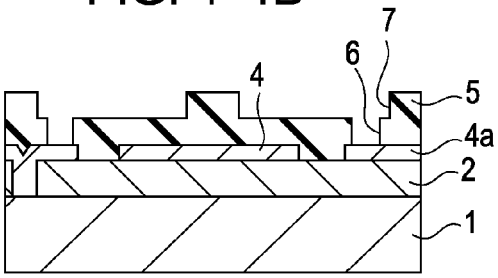
Figures 1A, 5:
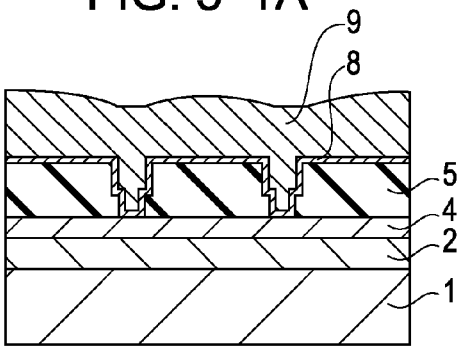
Figures 1B, 5:
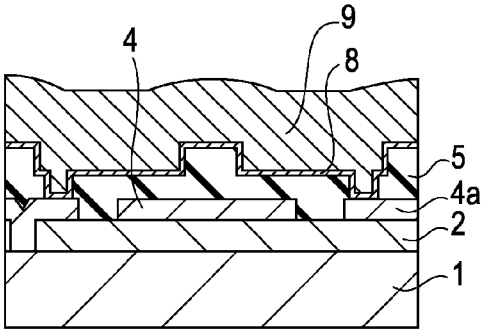
Figures 2A, 5:
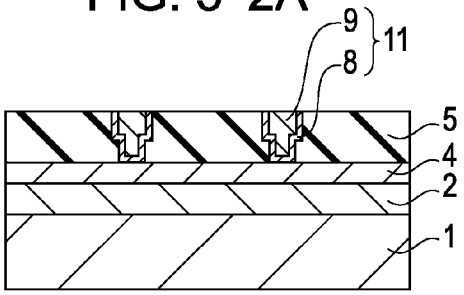
Figures 2B, 5:
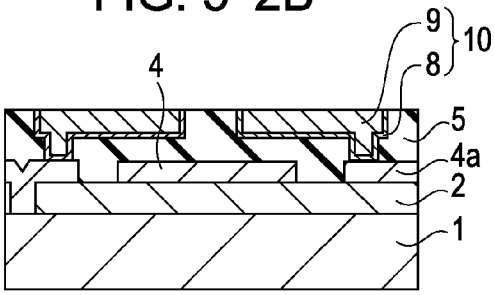
Figures 3A, 5:
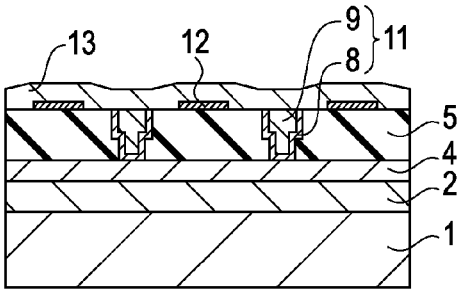
Figures 3B, 5:
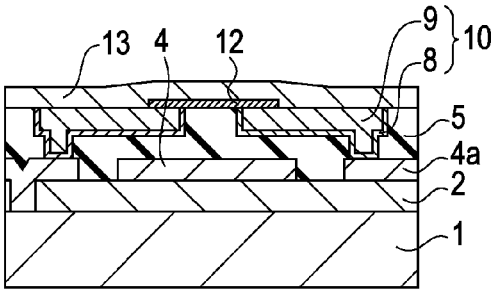

Next, the insulating layer 5 is partially etched until the heat conduction layer 4 and the electrode layer 4*a* are exposed, thereby forming openings 6 and electrode grooves 7 (refer to FIGS. 4-4A and 4-4B). A film 8 composed of Ta/TaN is formed, at a thickness of 50 nm, by sputtering so as to be in contact with the entire surface of the substrate including the openings 6 and the electrode grooves 7, the film 8 serving as a barrier layer against Cu used for electrodes 10. The film 8 prevents diffusion of Cu into the insulating layer 5 under the influence of heat applied in the subsequent step, and also serves as an adhesion layer between electrodes 10 and the insulating layer 5. After the film 8 is formed, a Cu layer serving as a seed layer (not shown) for electroplating is formed by sputtering, at a thickness of 50 nm, over the entire surface of the substrate. Using the seed layer as an electrode, a film 9 composed of Cu is formed by plating over the entire surface of the substrate (refer to FIGS. 5-1A and 5-1B). The substrate provided with the film 9 composed of Cu is subjected to a smoothing treatment by CMP until the surface of the insulating layer 5 is exposed, thereby forming electrodes 10 and heat conduction members 11 (refer to FIGS. 5-2A and 5-2B).

Next, a TaSiN layer used for heating portions 12 is formed by sputtering, at a thickness of 50 nm, over the entire surface of the substrate, and subjected to patterning to remove unnecessary portions of the TaSiN layer by etching. In this step, the heating portions 12 are disposed on the insulating layer 5 such that each of the heat conduction members 11 is located between two adjacent heating portions 12 and so as not to be in contact with the heat conduction members 11. Furthermore, a protection film 13 composed of $Si_3N_4$ is formed by CVD, at a thickness of 300 nm, over the entire surface of the substrate including the heating portions 12 (refer to FIGS. 5-3A and 5-3B).

As described above, by using the damascene process, the electrodes 10 and the heat conduction members 11 can be formed at one time, and the time required for manufacture can be shortened. Furthermore, by subjecting the electrodes 10 and the heat conduction members 11 to the smoothing treatment so that the surfaces of the electrodes 10, the heat conduction members 11, and the insulating layer 5 are smoothed, even when the ejection ports 1010 are formed in the orifice plate 14 by a photolithographic technique, it is possible to prevent the shape of the ejection ports 1010 from being deformed.

Second Embodiment

Figure 7A:
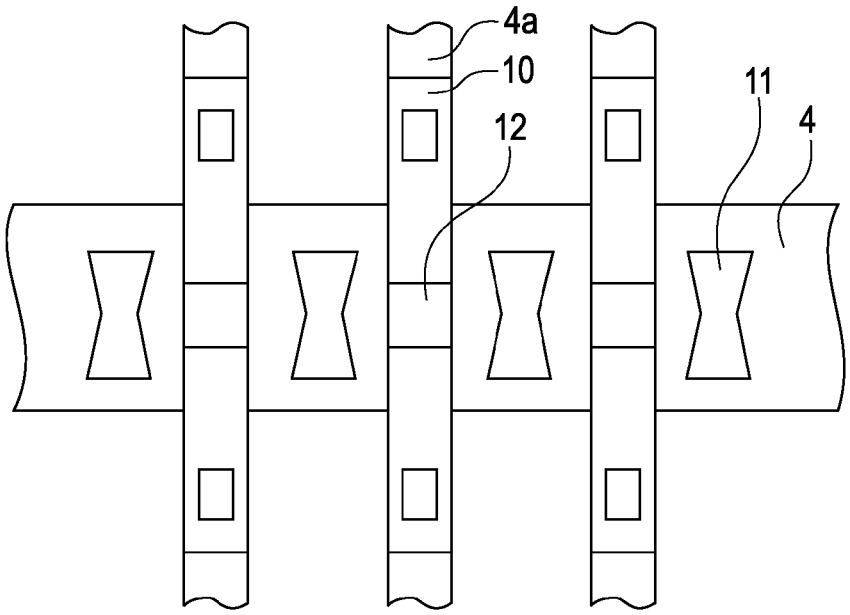
FIGS. 7A and 7B are each a schematic plan view of a recording element substrate according to a second embodiment.
Figure 7B:
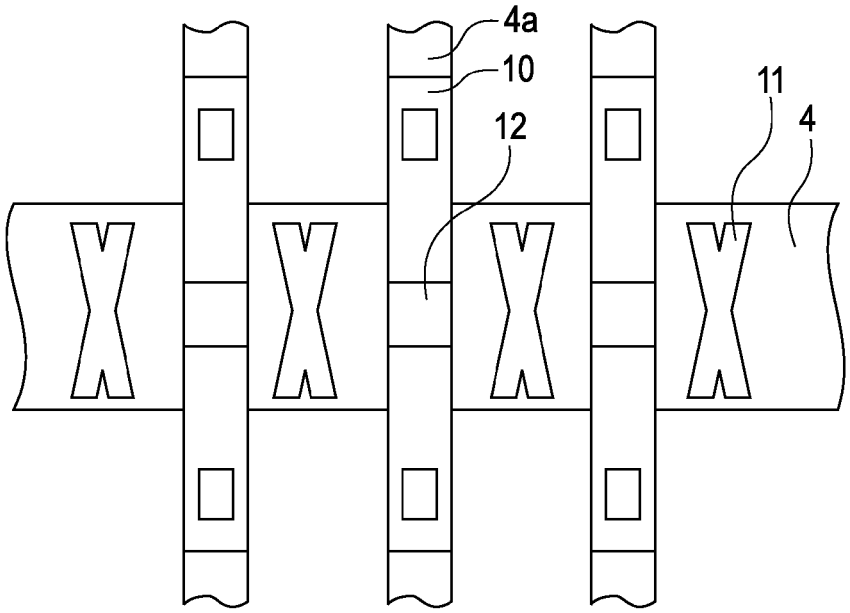

Examples according to a second embodiment of the present invention are shown in FIGS. 7A and 7B. The structure and the manufacturing method in the second embodiment are the same as those in the first embodiment except for the shape of the heat conduction members 11, and thus, a repeated description thereof will be omitted. As shown in the first embodiment, by providing the heat conduction members 11 as shown in FIG. 1, thermal interference can be prevented. In the case where higher speed is required, adjustment can be made by increasing the volume of the heating portions 12. However, if the distance between each of the heat conduction members 11 and its adjacent heating portion 12 is too small, the insulating layer 5 cannot produce an effect as a heat storage layer, and heat of the heating portion 12 escapes to the heat conduction member 11 before ink is subjected to film boiling. Therefore, it is necessary to locate the heat conduction member 11 at a position at least 1 μm away from its adjacent heating portion 12. In such a case, as shown in FIGS. 7A and 7B, the volume of each of the heat conduction members 11 can be increased by setting the width of the heat conduction member 11 located at a position away from a straight line joining the centers of the heating portions 12 to be larger than the width of the heat conduction member 11 on the straight line joining the centers of the heating portions 12. By forming the heat conduction members 11 so as to have such a shape, while ensuring the distance required for heat storage, excess heat generated in the heating portions 12 can be more efficiently dissipated.

Consequently, even when high-speed recording is performed using a recording element substrate 1050 having heating portions 12 arranged at a high density, by increasing the volume of each of the heat conduction members 11 as described above, the amount of heat that can be absorbed is increased. Thus, the heat of its adjacent heating portion 12 can be efficiently dissipated. As a result, heat of the adjacent heating portions 12 is not transmitted through the insulating layer 5 to cause thermal interference, and it is possible to provide a highly reliable recording element substrate capable of performing stable recording.

Third Embodiment

Figure 8A:
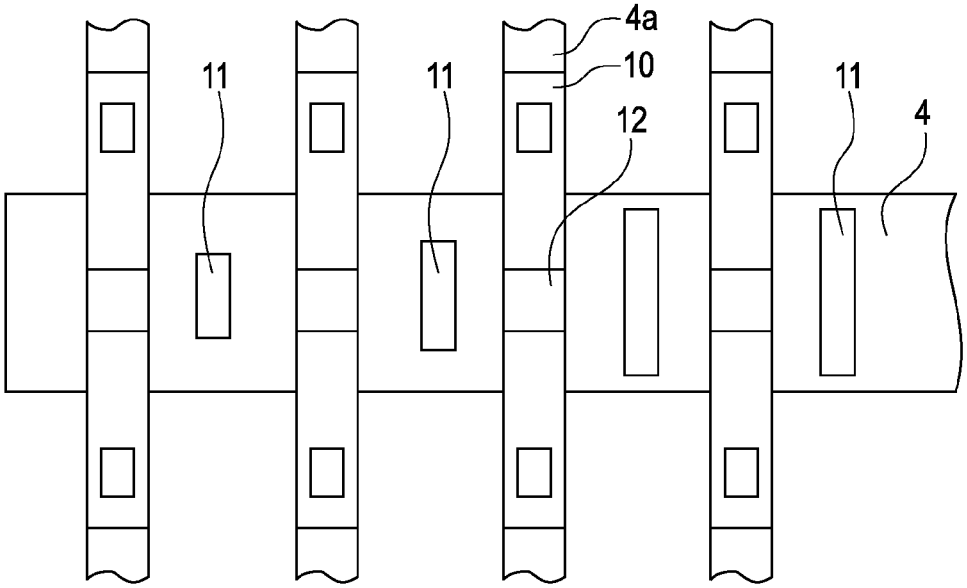
FIGS. 8A and 8B are each a schematic plan view of a recording element substrate according to a third embodiment.
Figure 8B:
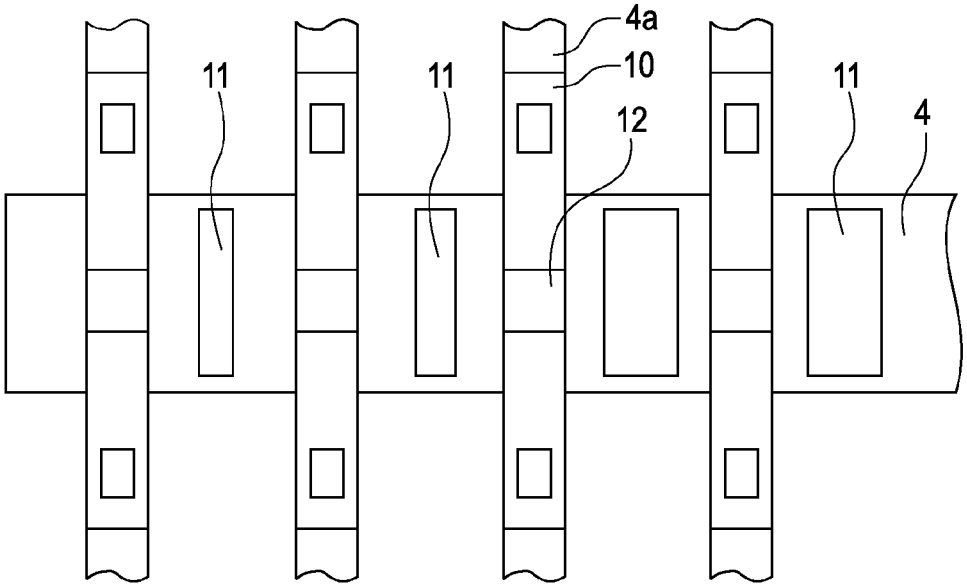
Figure 9:
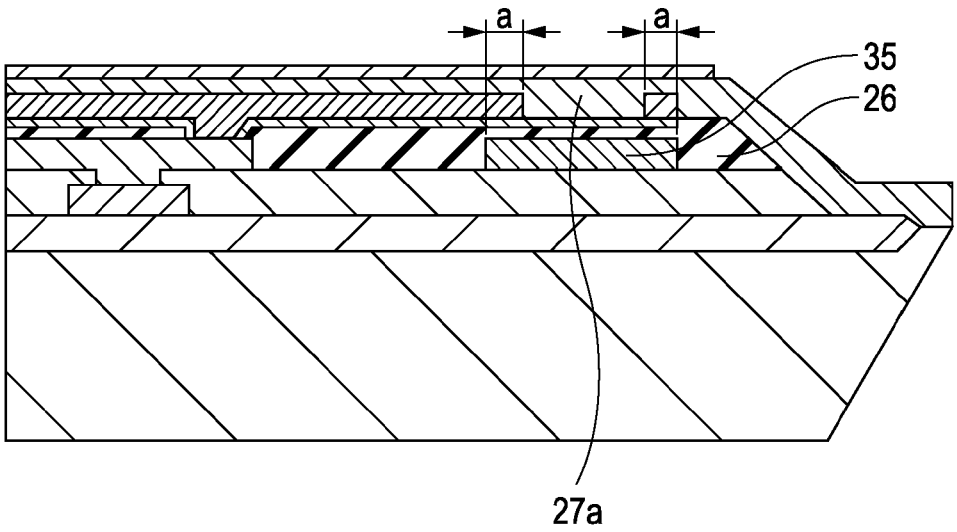
FIG. 9 is a cross-sectional view of an inkjet head substrate according to a related art.

Examples according to a third embodiment of the present invention are shown in FIGS. 8A and 8B. The structure and the manufacturing method in the third embodiment are the same as those in the first embodiment except for the shape of the heat conduction members 11, and thus, a repeated description thereof will be omitted.

FIGS. 8A and 8B are each a schematic plan view showing an end portion of the arrangement of heating portions 12 which are arranged at a predetermined pitch as shown in FIG. 6. In the recording element substrate 1050, since the heating portions 12 are densely located in the central region, heat is more easily stored in the central region than in the end region. When there is a temperature variation between the central region and the end region of the recording element substrate 1050, ink on a heating portion 12 located in the central region is heated faster than ink on a heating portion 12 located in the end region, resulting in a variation in ejection. Such a phenomenon results in a marked difference in temperature, in particular, in a recording element substrate which includes a plurality of rows of heating portions 12. In order to reduce the difference in temperature, as shown in FIGS. 8A and 8B, the volume of a heat conduction member 11 disposed in the center of the arrangement can be set larger than the volume of a heat conduction member 11 disposed at the end of the arrangement. The volume of each of the heat conduction members 11 can be appropriately set according to the arrangement density of the heating portions 12 and the temperature of the recording element substrate 1050 during continuous recording.

As in this embodiment, by increasing the volume of the heat conduction member 11 disposed in the center of the arrangement, heat dissipation can be performed more efficiently than at the end of the arrangement, and the temperature variation can be reduced in the recording element substrate 1050. Consequently, when high-speed recording is performed using such a recording element substrate 1050, it is possible to reduce thermal interference between the adjacent heating portions 12. Furthermore, by reducing the temperature variation in the plane of the recording element substrate 1050, it is possible to provide a highly reliable recording element substrate capable of performing stable recording without a variation in ejection.

Fourth Embodiment

In each of the first to third embodiments, the structure is disclosed in which, by disposing the heat conduction members 11 having higher thermal conductivity than the insulating layer between the adjacent heating portions 12 with respect to the arrangement direction, heat generated in the heating portions 12 is transmitted to the heat conduction members 11 and dissipated through the heat conduction layer 4. In this embodiment, a structure is disclosed in which the heat conduction layer 4 is not provided, and heat generated in the heating portions 12 is dissipated from the heat conduction members 11 directly to the substrate 1. Except for this feature, other structures and materials can be the same as those disclosed in the first to third embodiments.

Figures 1, 10:
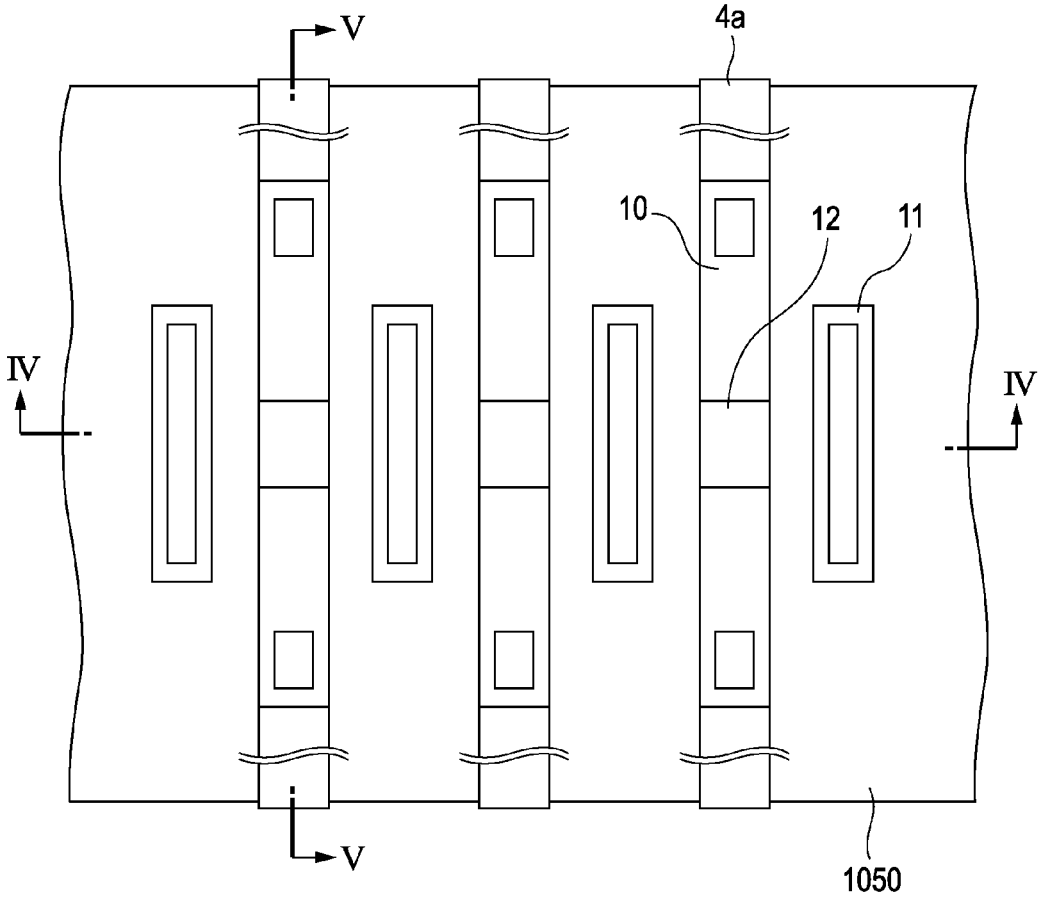
Figures 2, 10:
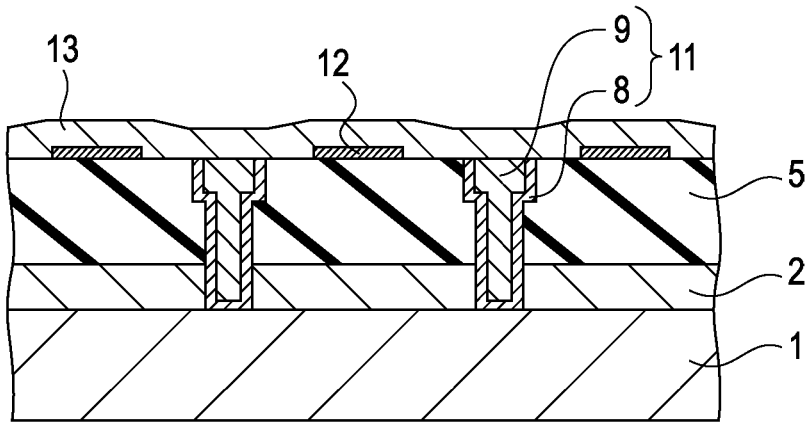
Figures 3, 10:
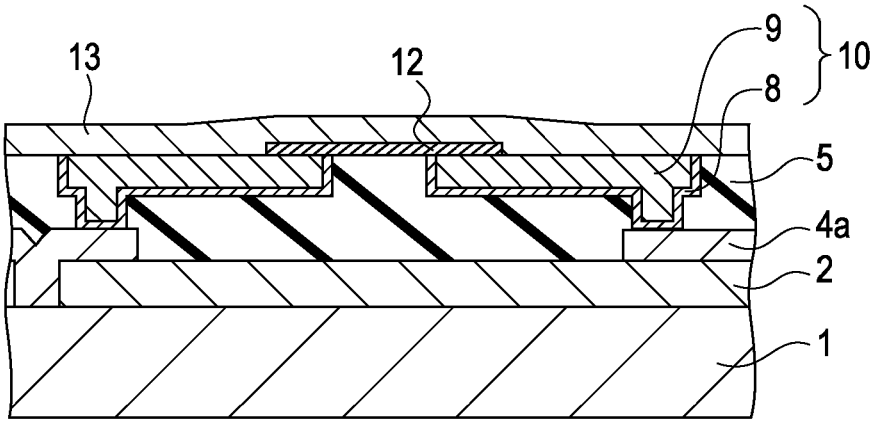

FIG. 10-1 is a schematic plan view showing a part of a recording element substrate according to this embodiment. FIG. 10-2 is a schematic cross-sectional view taken along the line IV-IV of FIG. 10-1, and FIG. 10-3 is a schematic cross-sectional view taken along the line V-V of FIG. 10-1. Each of the heat conduction members 11 located between two adjacent heating portions passes through the insulating layer 5 and the interlayer film 2 into contact with the substrate 1. Each of the electrodes 10 passes through the insulating layer 5 and is connected to an electrode layer 4*a* used for applying a voltage to the heating portion 12.

By using such an arrangement, heat generated in the heating portions 12 is efficiently transmitted from the insulating layer 5 through the heat conduction members 11 to the substrate 1. Thus, it is possible to prevent an increase in the temperature of the insulating layer 5 surrounding the heating portions 12.

Openings 6 for the heat conduction members 11 and openings 6 for the electrodes 10 can be simultaneously formed by etching using a gas which etches the insulating layer 5 and the interlayer film 2, but does not etch the material for the electrode layer 4*a*. By using such a gas, the openings 6 for the electrodes 10 are formed by etching so as to extend to the surface of the electrode layer 4*a*, and the openings 6 for the heat conduction members 11 are formed by etching so as to extend to the surface of the substrate 1. Specifically, it is possible to use a CF4-based gas which does not etch aluminum used for the electrode layer 4*a*, but easily etches $SiO_2$ used for the insulating layer 5 and the interlayer film 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-074363 filed Mar. 25, 2009, which is hereby incorporated by reference herein in its entirety.

What is claimed is:

1. A recording element substrate comprising:

a substrate;

an insulating layer disposed on or above the substrate;

a plurality of heating portions which are arranged on the insulating layer and which produce thermal energy used to eject a liquid;

a heat conduction layer disposed inside the insulating layer and having higher thermal conductivity than the insulating layer; and a plurality of heat conduction members, each being located between adjacent heating portions with respect to an arrangement direction of the heating portions, the heat conduction members passing through the insulating layer between a surface of the insulating layer on which the heating portions are arranged and the heat conduction layer so as to be in contact with the heat conduction layer, the heat conduction members having higher thermal conductivity than the insulating layer.

2. The recording element substrate according to claim 1, wherein, with respect to the arrangement direction of the heating portions, the insulating layer is disposed between the heat conduction members and their adjacent heating portions.

3. The recording element substrate according to claim 1, further comprising electrodes electrically connected to the heating portions, the electrodes being composed of the same material as the heat conduction members.

4. The recording element substrate according to claim 3, wherein the electrodes contain one or more selected from Al, Cu, W, and Au.

5. The recording element substrate according to claim 1, wherein the heat conduction members contain one or more selected from Al, Cu, W, and Au.

6. The recording element substrate according to claim 1, wherein a width of each of the heat conduction members in a direction orthogonal to the arrangement direction is larger than a width of each of the heating portions in the direction orthogonal to the arrangement direction.

7. The recording element substrate according to claim 1, wherein, among the heat conduction members, a volume of a heat conduction member disposed in the center of the arrangement of the heating portions is larger than a volume of a heat conduction member disposed at an end of the arrangement of the heating portions.

8. The recording element substrate according to claim 1, wherein the shortest distance between each of the heat conduction members and its adjacent heating portion is 1 to 5 μm.

9. A liquid ejection head comprising:

the recording element substrate according to claim 1; and ejection ports configured to eject a liquid, the ejection ports being disposed so as to correspond to the heating portions.

10. A recording element substrate comprising:

a substrate;

an insulating layer disposed on or above the substrate;

a plurality of heating portions which are arranged on the insulating layer and which produce thermal energy used to eject a liquid; and a plurality of heat conduction members, each being located between the adjacent heating portions with respect to an arrangement direction of the heating portions, the heat conduction members passing through the insulating layer between a front surface and a back surface of the insulating layer, the heat conduction members having higher thermal conductivity than the insulating layer.

* * * * *